US006480773B1

(12) United States Patent
Hilgart

(10) Patent No.: US 6,480,773 B1
(45) Date of Patent: Nov. 12, 2002

(54) AUTOMATIC BOOM SOFT SETDOWN MECHANISM

(75) Inventor: Randall D. Hilgart, Milwaukee, WI (US)

(73) Assignee: Harnischfeger Industries, Inc., Wilmington, DE (US)

( * ) Notice: Subject to any disclaimer, the term of this patent is extended or adjusted under 35 U.S.C. 154(b) by 4 days.

(21) Appl. No.: 09/635,343

(22) Filed: Aug. 9, 2000

(51) Int. Cl.[7] ..... E02F 3/00
(52) U.S. Cl. ..... 701/50; 37/348; 414/690
(58) Field of Search ..... 414/718, 728, 414/690; 37/395, 396, 397, 398, 399, 348; 701/50

(56) References Cited

U.S. PATENT DOCUMENTS 5,408,767 A * 4/1995 Hazama et al. ..... 414/718 X
5,469,647 A * 11/1995 Profio ..... 414/718 X

* cited by examiner

*Primary Examiner*—Donald W. Underwood
(74) *Attorney, Agent, or Firm*—James Earl Lowe, Jr.

(57) ABSTRACT

A shovel including a dipper for gathering material from a bank. The shovel further includes a hoist motor operating control for operating a hoist motor, a speed sensor for monitoring the hoist motor speed, a torque sensor for monitoring the hoist motor torque, and a mechanism communicating with a crowd motor control, the torque sensor and the speed sensor for moving a dipper handle toward a boom when the hoist motor speed is below a low-speed value while under high torque, and for permitting movement of the dipper away from the boom when the hoist motor speed is above the low-speed value or not under high torque. The shovel further includes a linear resolver mounted on the platform, a rod having one end pivotally attached to the boom and another end attached to the linear resolver, movement of the rod causing a change in position of the linear resolver, a position mechanism for determining the position of the linear resolver, and a PLC communicating with the position mechanism and the crowd motor control mechanism for moving the dipper handle toward the boom in response to the position mechanism indicating the linear resolver has changed its position from a set point. The linear resolver includes a magnet slidably mounted on a base attached to the platform.

4 Claims, 3 Drawing Sheets

AUTOMATIC BOOM SOFT SETDOWN MECHANISM

BACKGROUND OF THE INVENTION

The invention is directed to a power shovel including a dipper for gathering material from a bank and then moving the material to either a material pile or a truck for removing the material from the work site. More particularly, this invention is directed to a mechanism for reducing structural damage to the power shovel boom.

The power shovel includes a platform and an upwardly extending boom pivotally connected at the lower end to the platform. The boom is held in a upwardly and outwardly extending relation to the platform by a brace in the form of tension cables which are anchored to a back stay of a stay structure rigidly mounted on the platform. The power shovel also includes a dipper connected to a dipper handle. The dipper handle is slidably supported in a saddle block which is pivotally mounted on the boom. The dipper handle is movable away from and towards the boom in order to engage the bank of material. In some circumstances, the dipper can engage a hard surface. If the dipper and dipper handle continue to move away from the boom, then the boom will be pivoted away from the dipper. This is not a desirable situation. When an operator detects that this has happened, the operator will pull the dipper back towards the boom. If this occurs too quickly, and it often does, the boom will come down with a impact against the tension cables which support the boom. This situation of causing the boom to be pivoted away from the dipper and then brought back down with an impact on the boom is referred to as boom jacking.

Still more particularly, this invention is directed to a mechanism for automatically setting the boom down softly when boom jacking occurs.

In conventional shovels (See FIG. 2), boom jacking protection is provided by a rod 34 which has a first end attached to the boom 15 and has a second end which extends through an opening into the machinery housing. Included on the rod second end is a limit switch engaging member 31. Mounted adjacent the rod 34 within the machinery housing are a pair of spaced apart limit switches 33 and 35. The first limit switch 33 is intended to be engaged by the limit switch engaging member 31 upon initial pivoting of the boom 15. In order to properly set the location of the first limit switch 33 in order to respond to initial pivoting of the boom 15, the first limit switch 33 is adjustable in its position along the length of the rod 34. When the first limit switch 33 is engaged, a control takes over causing gradual movement of the dipper and dipper handle 25 towards the boom 15. Since in many instances the first limit switch 33 is not in the proper position to accurately reflect a true boom jacking situation, many operators move the first limit switch 33 back to where substantial boom jacking must first occur before the first limit switch 33 is engaged.

The second limit switch 35 is intended to be engaged when substantial boom jacking has occurred. When this happens, the operator brakes are set, and the operator must manually release the brakes before continuing digging operations.

SUMMARY OF THE INVENTION

This invention substantially improves over this prior art construction. The location of a first limit switch position is no longer variable. The device of this invention automatically sets a reference set point. As a result, operators can no longer reduce the ability of the system to properly react to a boom jacking situation.

This invention is a shovel including a dipper for gathering material from a bank, a platform, an upwardly extending boom connected at a lower end to the platform, and a sheave rotatably amounted on the upper end of the boom. The shovel further includes a winch drum mounted on the platform, a hoist motor for rotating the winch drum, and a hoist rope extending from the winch drum over the sheave and attached to the dipper. The shovel further includes a saddle block pivotally mounted on the boom, and a dipper handle slidably supported by the saddle block, and pivotable relative to the boom by the saddle block. The shovel further includes dipper handle moving means for moving the dipper and dipper handle away from and towards the boom, the means including a crowd motor, and crowd motor operating means for operating the crowd motor. The shovel further a linear resolver mounted on the platform, a rod having one end pivotally attached to the boom and another end attached to the linear resolver, movement of the rod causing a change in position of the linear resolver, a position means for determining the position of the linear resolver, and means communicating with the position means and the crowd motor control means for moving the dipper handle toward the boom in response to the position means indicating the linear resolver has changed its position from a set point.

In one embodiment, the linear resolver includes a magnet slidably mounted on a base attached to the platform. The shovel further includes a set point determining means for determining the linear resolver set point, the set point determining means including hoist pay out means for determining how much of the hoist rope has been paid out, start means for determining if the power shovel electrical power system has been turned on, and means communicating with the hoist pay out means and the start means for selecting the set point at the position of the linear resolver when the power shovel electric power system is turned on when the hoist pay out means indicates that the hoist rope has been substantially paid out.

One of the principle objects of this invention is to substantially reduce boom damage caused by boom jackings.

Figure 1:
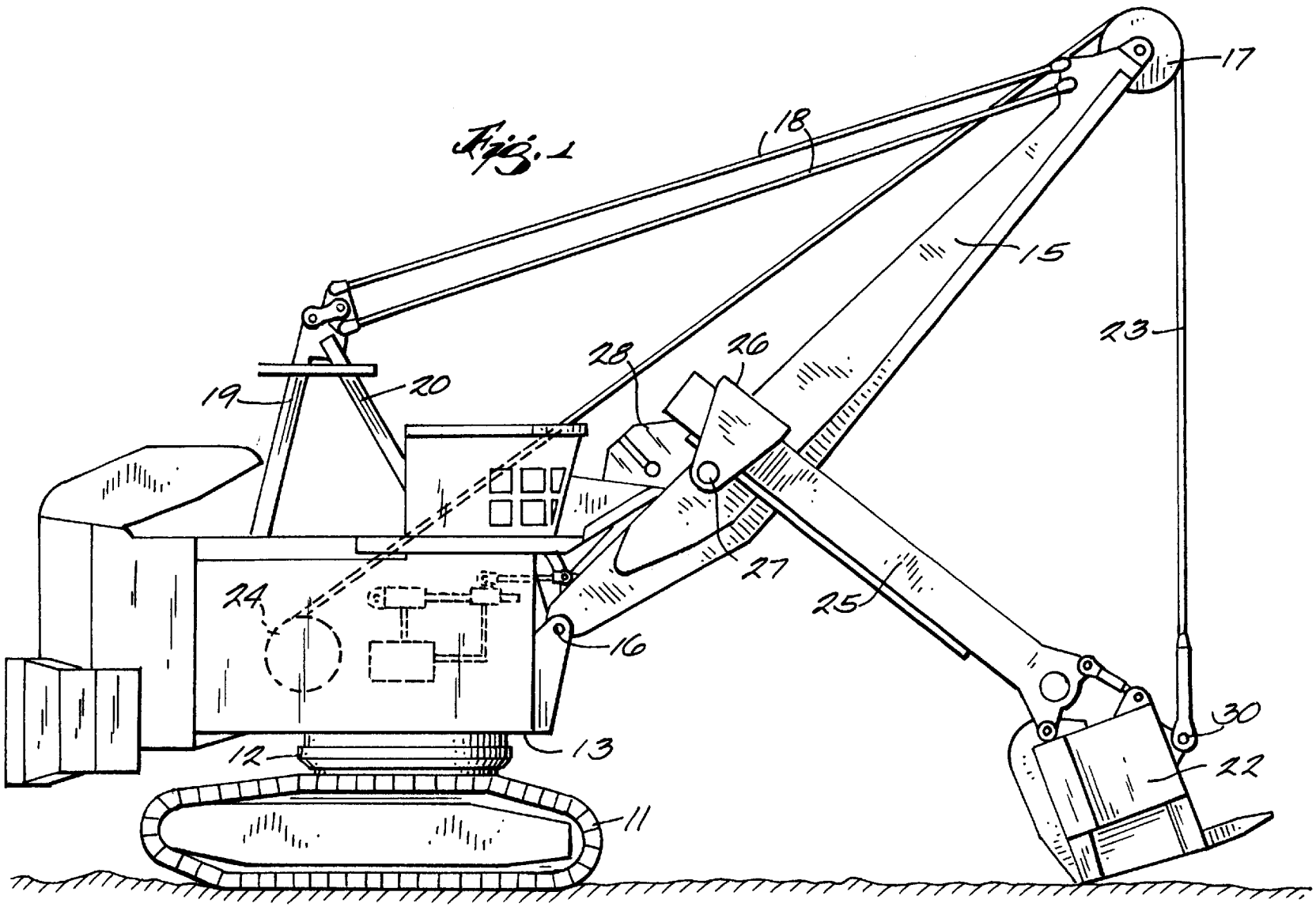
FIG. 1 is a plan view of a surface mining shovel.
Figure 2:
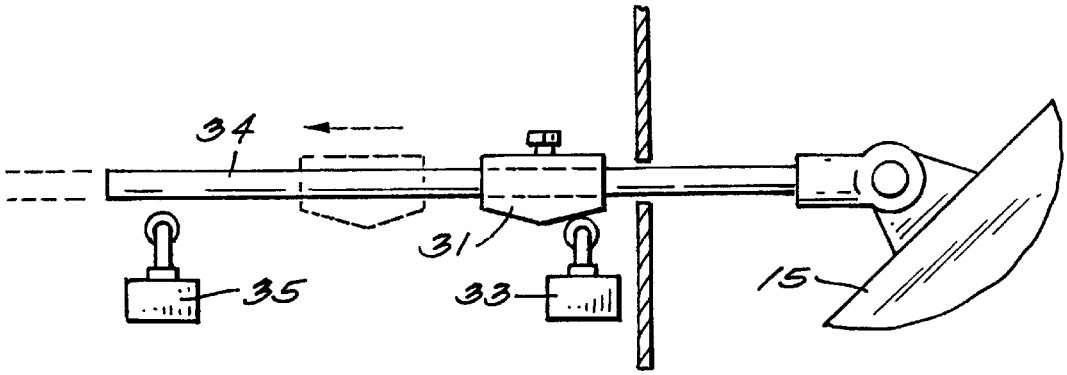
Fig. 2. PRIOR ART
FIG. 2 is a schematic illustration of a prior art boom soft set down device.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof, as well as additional items. Use of "consisting of" and variations thereof as used herein is meant to encompass only the items listed thereafter and equivalents thereof.

DETAILED DESCRIPTION OF A PREFERRED EMBODIMENT

The invention is directed to a power shovel 8 including a dipper 22 for gathering material from a bank (not shown) and then moving the material to either a material pile (not shown) or a truck (not shown) for removing the material from the work site.

The power shovel 8 includes a platform in the form of a machinery deck 13, and an upwardly extending boom 15 connected at the lower end 16 to the platform 13, and a sheave 17 at the top of the boom 15. The dipper 22 is suspended from the boom 15 by a hoist rope 23 trained over the sheave 17 and attached to the dipper 22 at a bail pin 30. The machine structure is movable to locate the dipper 22 in respective loaded and unloading positions. More particularly, the structure is mounted on a turntable 12.

Referring to FIG. 1 the power shovel depicted therein of the well known construction commonly referred to as a rope shovel. This shovel loader comprises a mobile base 10 supported on drive tracks 11, and having supported thereon through the turntable 12, the machinery deck 13. The turntable 12 permits full 360° rotation of the machinery deck relative to the base.

The boom 15 is pivotally connected at 16 to the machinery deck 13. The boom 15 is held in a upwardly and outwardly extending relation to the deck by a brace in the form of tension cables 18 which are anchored to a back stay 19 of a stay structure 20 rigidly mounted on the machinery deck 13.

The dipper 22 is suspended by the hoist rope or cable 23 from the sheave 17, the hoist rope being anchored to a winch drum 24 mounted on the machinery deck 13. As the winch drum rotates, the hoist rope 23 is either paid out or pulled in, lowering or raising the dipper 22. The dipper has a handle 25 rigidly attached thereto, with the dipper handle 25 slidably supported in a saddle block 26, which is pivotally mounted on the boom 15 at 27. The dipper handle has a rack tooth formation thereon (not shown) which engages a drive pinion (not shown) mounted in the saddle block 26. The drive pinion is driven by an electric motor and transmission unit 28 to effect extension or retraction of the dipper handle 25 relative to the saddle block 26.

A source of electrical power (not shown) is mounted on the machinery deck 13 to provide power to one or more hoist electric motors 73 which drives the winch drum 24, a crowd electric motor 75 which drives the saddle block transmission unit 28, and a swing electric motor (not shown) which turns the machinery deck turntable 12.

A PLC, or Programmable Logic Controller, is a small computer conventionally used to control large machinery, such as power shovels. The PLC includes memory for storing information, such as a linear resolver set point. The PLC can execute stored programs in order to control the voltage, current, and direction of rotation of motors, such as crowd control and hoist motors.

The above described basic construction of the shovel loader is widely known and used and further details of the construction are not provided as they are well known in the art.

The shovel 8 further includes (see FIG. 3) a linear resolver 32 mounted on the platform 13, a rod 34 having one end pivotally attached to the boom 15 and another end attached to the linear resolver 32, movement of the rod 34 causing a change in position of the linear resolver 32, and a position means 38 for determining the position of the linear resolver 32. More particularly, the position means is a PLC, and the PLC also communicates with a crowd motor control mechanism for moving the dipper handle 25 toward the boom 15 in response to the position mechanism indicating the linear resolver 32 has changed its position from a set point.

The PLC thus monitors the position of the linear resolver 34. If the linear resolver 32 moves from the set point, the PLC tells the crowd motor control to slowly retract the dipper handle 25 if the operator has the operator crowd motor control in either a dipper handle forward position or a dipper handle reverse position. If the operator has the crowd motor control in a neutral position, the machine stays in an idle condition. This is to prevent the machine operating when the operator is not expecting the machine to operate. The PLC will continue to slowly retract the dipper handle 25 toward the boom 15 until the dipper handle 25 has reached a near fully retracted position.

If the PLC detects that there has been a substantial change in the position of the linear resolver 32, then the PLC will set the operator brakes. The operator will then need to manually release the brakes before continuing operation of the shovel 8.

Figure 3:
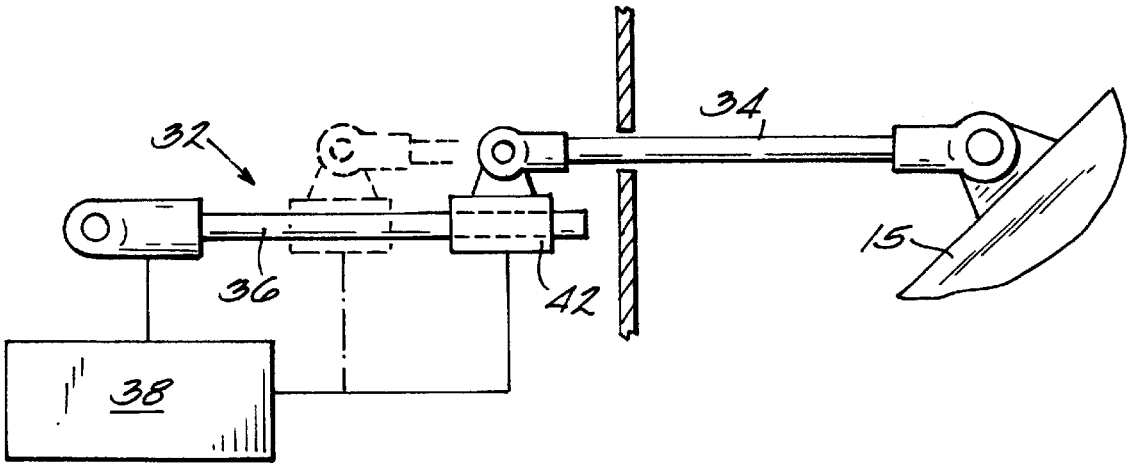
FIG. 3 is a schematic illustration of a boom soft set down device in accordance with this invention.
Figure 4:
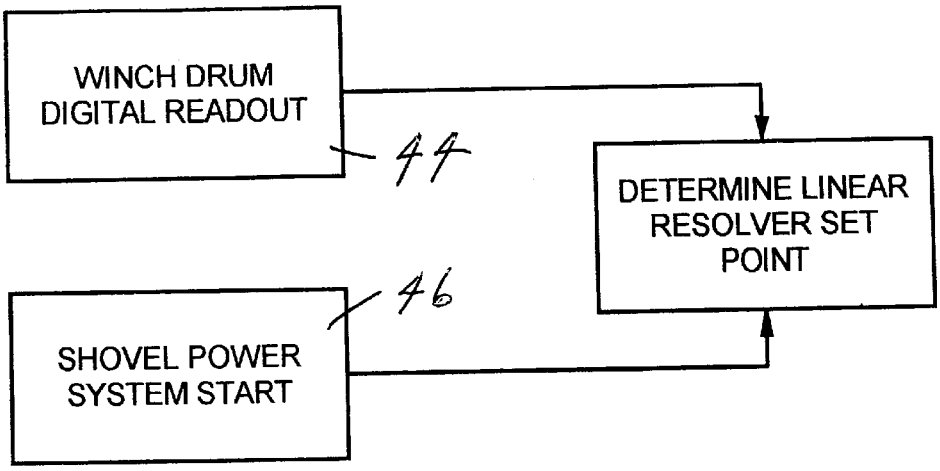
FIG. 4 is a schematic illustration of a set point determining mechanism in accordance with this invention.
Figure 5:
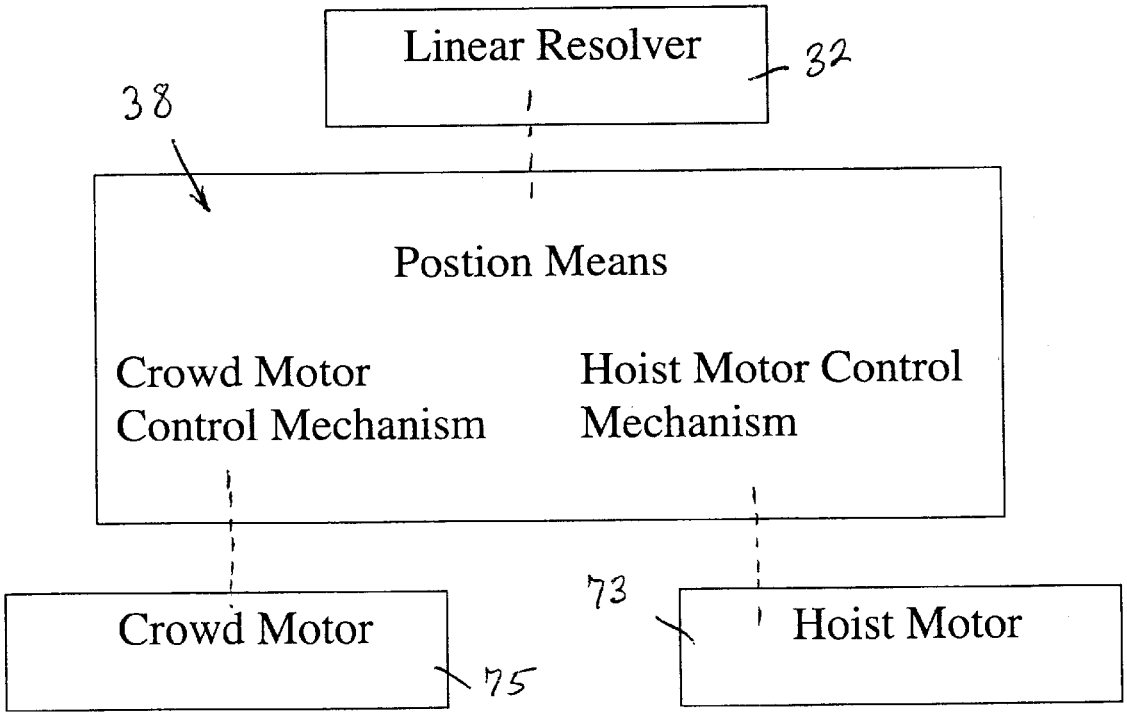
FIG. 5 is a schematic illustration of the overall control in accordance with this invention.

In a preferred embodiment, as shown in FIG. 3, the linear resolver includes a magnet 42 slidably mounted on a base 36 attached to the platform 13. The shovel 8 further includes a set point determining means (see FIG. 4) for determining the linear resolver set point, the set point determining means including hoist pay out means 44 for determining how much of the hoist rope 23 has been paid out, start means 46 for determining if the power shovel electrical power system has been turned on, and means in the form of a program in the PLC for communicating with the hoist pay out means 44 and the start means 46 for selecting the set point at the position of the linear resolver 34 when the power shovel electric power system is turned on when the hoist pay out means indicates that the hoist rope has been substantially paid out. This occurs when the dipper 22 is generally set down on the ground, as shown in FIG. 1.

More particularly, the hoist pay out means is part of the winch drum arrangement 24 and includes a digital readout in communication with the PLC. The start means is an electric feed to the PLC indicating the shovel power system has been started.

What is claimed is:

1. A shovel including a dipper for gathering material from a bank, a platform, an upwardly extending boom connected at a lower end to the platform, a sheave rotatably amounted on the upper end of the boom, a winch drum mounted on the platform, a hoist motor for rotating the winch drum, a hoist rope extending from the winch drum over the sheave and attached to the dipper, a saddle block pivotally mounted on the boom, a dipper handle slidably supported by the saddle block, and pivotable relative to the boom by the saddle block, moving means for moving the dipper and dipper handle away from and towards the boom, said means including a crowd motor, crowd motor operating means for operating the crowd motor, hoist motor operating means for operating the hoist motor, a linear resolver mounted on the platform, a rod having one end attached to the boom and another end attached to the linear resolver, movement of the rod causing a change in position of the linear resolver, position means for determining the position of the linear resolver, and means communicating with the position means and the crowd motor operating means for moving the dipper handle toward the boom in response to the position means indicating the linear resolver has changed its position from a set point.

2. A power shovel in accordance with claim 1, the linear resolver including a magnet slidably mounted on a base attached to the platform.

3. A power shovel in accordance with claim 1 and further including set point determining means for determining the linear resolver set point, said set point determining means including hoist pay out means for determining how much of the hoist rope has been paid out, start means for determining if the power shovel electrical power system has been turned on, and means communicating with said hoist pay out means and said start means for selecting said set point at the position of the linear resolver when the power shovel electric power system is turned on when the hoist pay out means indicates in the hoist rope has been substantially paid out.

4. A power shovel in accordance with claim 1 wherein said rod is pivotally attached to the boom.

* * * * *